US009068697B2

(12) United States Patent
Leneve et al.

(10) Patent No.: US 9,068,697 B2
(45) Date of Patent: Jun. 30, 2015

(54) SUBAQUEOUS MINING TAILINGS PLACEMENT

(71) Applicant: SYNCRUDE CANADA LTD. in trust for the owners of the Syncrude Project as such owners exist now and in the future, Fort McMurray (CA)

(72) Inventors: Eric Leneve, Fort McMurray (CA); Ron Cleminson, Fort McMurray (CA); Nan Wang, Edmonton (CA)

(73) Assignee: SYNCRUDE CANANDA LTD., Fort McMurray (CA), In trust for the owners of the Syncrude Project as such owners exist now and in the future ( * ) Notice: Subject to any disclaimer, the term of this patent is extended or adjusted under 35 U.S.C. 154(b) by 180 days.

(21) Appl. No.: 14/013,824

(22) Filed: Aug. 29, 2013

(65) Prior Publication Data

US 2014/0116521 A1 May 1, 2014

Related U.S. Application Data

(60) Provisional application No. 61/719,454, filed on Oct. 28, 2012.

(51) Int. Cl.
*F26B 21/00* (2006.01)
*F17D 3/01* (2006.01)

(52) U.S. Cl.
CPC ..... *F17D 3/01* (2013.01); *Y10T 137/0335* (2015.04)

(58) Field of Classification Search
CPC ..... F26B 7/00; F26B 21/00; F26B 21/03; B09C 1/00; B02C 19/00; B02C 19/056; B01D 21/01; B01D 21/24; C02F 1/52
USPC ..... 34/386, 404, 413, 497; 405/128.7; 241/152.1, 158; 210/702, 732, 738
See application file for complete search history.

(56) References Cited

U.S. PATENT DOCUMENTS

| | | | | | |
|---|---|---|---|---|---|
| 3,805,713 | A * | 4/1974 | Notary et al. | 110/245 |
| 4,541,752 | A * | 9/1985 | Phillips | 405/129.85 |
| 4,720,346 | A * | 1/1988 | Flesher et al. | 210/734 |
| 5,843,320 | A * | 12/1998 | Huang et al. | 210/723 |
| 6,007,708 | A * | 12/1999 | Allcock et al. | 208/391 |
| 8,137,566 | B2 * | 3/2012 | Bozak et al. | 210/703 |
| 8,806,774 | B2 * | 8/2014 | Lorentz et al. | 34/386 |
| 2004/0165960 | A1 * | 8/2004 | McTurk et al. | 406/137 |
| 2006/0043005 | A1 * | 3/2006 | Cleminson et al. | 208/390 |

(Continued)

FOREIGN PATENT DOCUMENTS

| | | | | |
|---|---|---|---|---|
| CA | 2825511 | A1 * | 4/2014 | |
| DE | 3442929 | A1 * | 5/1986 | B01J 35/02 |

(Continued)

*Primary Examiner* — Stephen M Gravini
(74) *Attorney, Agent, or Firm* — Bennett Jones LLP

(57) ABSTRACT

A process for reducing segregation of mining tailings while being deposited below the surface of a column of fluid is provided which comprises introducing the mining tailings into a downpipe having an inlet at or near the surface of the column of fluid and an outlet submerged in the column of fluid; providing at least one pressure drop element in the downpipe to prevent acceleration of the mining tailings and maintain the tailings flow therethrough; and providing a diffusing device at the outlet of the downpipe to reduce the velocity of the mining tailings as the tailings are discharged therefrom.

12 Claims, 5 Drawing Sheets

(56) References Cited

U.S. PATENT DOCUMENTS

| | | | | |
|---|---|---|---|---|
| 2009/0020458 | A1* | 1/2009 | Bozak et al. | 208/390 |
| 2009/0116908 | A1* | 5/2009 | Dymond et al. | 405/128.75 |
| 2010/0108572 | A1* | 5/2010 | Cleminson et al. | 208/390 |
| 2013/0112561 | A1* | 5/2013 | Jajuee et al. | 204/553 |
| 2013/0284641 | A1* | 10/2013 | Siy et al. | 208/391 |
| 2014/0101967 | A1* | 4/2014 | Lorentz et al. | 34/386 |
| 2014/0116521 | A1* | 5/2014 | Leneve et al. | 137/4 |
| 2014/0119833 | A1* | 5/2014 | Wang et al. | 405/128.7 |
| 2014/0150886 | A1* | 6/2014 | Kan et al. | 137/13 |

FOREIGN PATENT DOCUMENTS

| | | | |
|---|---|---|---|
| NL | 1014809 | | 10/2001 |
| WO | WO 2012114165 | A1 * | 8/2012 |

* cited by examiner

SUBAQUEOUS MINING TAILINGS PLACEMENT

FIELD OF THE INVENTION

The present invention relates to a process for depositing mining tailings subaqueously while minimizing segregation. In particular, a process is provided to prevent segregation of oil sands tailings such as composite oil sand tailings during deposition into a column of fluid by discharging the oil sands tailings into the column of fluid and managing the discharge velocity of the tailings therein.

BACKGROUND OF THE INVENTION

Oil sand generally comprises water-wet sand grains held together by a matrix of viscous heavy oil or bitumen. Bitumen is a complex and viscous mixture of large or heavy hydrocarbon molecules which contain a significant amount of sulfur, nitrogen and oxygen. The extraction of bitumen from sand using hot water processes yields large volumes of fine tailings composed of fine silts, clays, residual bitumen and water. Mineral fractions with a particle diameter less than 44 microns are referred to as "fines." These fines are typically clay mineral suspensions, predominantly kaolinite and illite.

The fine tailings suspension is typically 85% water and 15% fine particles by mass. Dewatering of fine tailings occurs very slowly. When first discharged in ponds, the very low density material is referred to as thin fine tailings. After a few years when the fine tailings have reached a solids content of about 30-35%, they are referred to as mature fine tailings (MFT) which behave as a fluid-like colloidal material. Such fine tailings are generally referred to herein as fluid fine tailings. The fact that fluid fine tailings (FFT) behave as a fluid and have very slow consolidation rates significantly limits options to reclaim tailings ponds.

One approach to disposal/management of FFT is the Composite Tails (CT) process, which involves mixing a coarse tailings stream (e.g., sand) with an FFT stream and adding a coagulant such as gypsum to form slurry that rapidly releases water when deposited and binds the FFT in a coarse tailings/FFT deposit. Thus, more of the fines can be stored in a geotechnical soil matrix, which reduces the inventory of fluid-fine tails and enables a wider range of reclamation alternatives. Thus, CT causes the tailings to settle faster, enabling the development of landscapes that support grass, trees and wetlands. Composite tailings are often referred to as "non-segregating" tailings, meaning that the fines do not readily separate from the coarser sand.

There are currently two primary methods for discharging CT into bodies of water. The first is to discharge the CT using a floating pipeline. The second is to overboard off a pit wall and allow the CT to cascade into the water. However, neither of these techniques addresses the need to reduce the slurry velocities below the dynamic segregation limits. Nor do these techniques minimize the water dilution effects of exposing the CT slurry to water. As a result, the majority of CT placed using the aforementioned two methods have a high propensity to segregate.

Accordingly, there is a need for an improved method of discharging oil sand tailings into a body of water to reduce segregation of the fine solids and the coarse solids present in the oil sand tailings.

SUMMARY OF THE INVENTION

In one aspect, the present invention describes a method for placing tailings such as composite tails/tailings (CT) under the surface of a column of fluid. Through the use of a device to control slurry velocities upon discharge, the applicant surprisingly discovered that segregation of tailings can be greatly reduced by minimizing the slurry discharge velocity to a value lower than the dynamic segregation value.

In the present invention, a downpipe, for example, a tremie pipe, is used and the mining tailings are introduced therethrough from the surface. Typically, the downpipe is inclined at an angle or may be substantially vertical. However, the downward flow of the tailings is accelerated by gravity and will cause turbulent mixing of the tailings. Thus, in addition to the reducing the discharge velocity, for example, by the addition of a diffusing device at the end of the downpipe, the present invention also manages the pressure in the downpipe, for example, by using pressure drop elements placed in the downpipe portion. The downpipe being in an inclined or vertical position would otherwise act to accelerate the fluid due to the density difference between the pond fluid and the higher density mining tailings, e.g., oil sands CT slurry. Thus, managing the tailings velocity to and through the downpipe along with further velocity reduction by using a device such as a radial diffuser at the end of the downpipe eliminates the risk of segregation caused by high dynamic energy discharge scenarios.

Similar devices can be used for all slurries that have dynamic segregation boundaries.

In one embodiment, the tailings such as oil sands CT would be placed below an existing tailings pond, e.g., in the case of oil sands tailings ponds, below the existing MFT layer. Thereby, both the risk of dynamic segregation and water dilution of the CT slurry would be significantly reduced.

Hence, in one aspect, a process is provided to reduce segregation of mining tailings while being deposited below the surface of a column of fluid, comprising:

- introducing the mining tailings into a downpipe having an inlet at or near the surface of the column of fluid and an outlet submerged in the column of fluid;
- providing at least one pressure drop element in the downpipe to prevent acceleration of the mining tailings and maintain the flow of the mining tailings therethrough; and
- providing a diffusing device at the outlet of the downpipe to reduce the velocity of the mining tailings as the tailings are discharged therefrom.

In one embodiment, the process further comprises:

- controlling the velocity of the mining tailings prior to introducing the tailings into the downpipe.

Examples of useful pressure drop elements are as follows: control valves, orifice plates, venturis, and similar pressure drop elements known to those skilled in the art.

In one embodiment, the downpipe is inclined. In another embodiment, the downpipe is substantially vertical.

In one embodiment, the mining tailings are oil sands composite tails (CT). In another embodiment, the mining tailings are oil sands fluid fine tailings (FFT). FFT are tailings having a solids content greater than 1% and a shear strength of less than 5 kPa, for example, oil sands mature fine tailings present in an oil sands tailings pond. It is understood, however, that the present invention can be used to prevent segregation of any mining tailings composition, including centrifuged oil sands tailings centrifuge cakes or other treated or untreated oil sands tailings.

In another embodiment, the column of fluid is an existing mining tailings pond. For example, in a typical oil sands tailings pond, striations or layers are formed. From the top of the pond to the bottom, there exists a water layer, a fluid fine tailings layer (mature fine tailings), a sand layer, and a hard bottom. In this instance, the oil sands tailings such as CT would be deposited at or near the sand layer.

In another aspect of the present invention, during the subaqueous deposition of mining tailings such as oil sands CT, the deposit growth is monitored and its characteristics measured in order to determine deposition pattern. Thus, accordingly, the diffuser can be relocated to manage deposit surfaces, thereby creating subaqueous deposits with minimal segregation.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF THE PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a process for depositing mining tailings such as oil sands tailings subaqueously while minimizing segregation. As used herein, the term "mining tailings" means any tailings derived from a mining operation. "Oil sands tailings" means tailings produced at any stage of oil sands extraction operations and containing a fines fraction. The term "oil sands tailings" is meant to include fluid fine tailings (FFT) from oil sands tailings ponds and fine tailings from ongoing oil sands extraction operations (for example, thickener underflow or froth treatment tailings) which may bypass a tailings pond. The present invention is particularly useful for the subaqueous disposal of Composite Tails (CT). As previously discussed, the Composite Tails (CT) process involves mixing a coarse tailings stream (e.g., sand) with an FFT stream (such as oil sands mature fine tailings) and adding a coagulant such as gypsum to form a slurry that rapidly releases water when deposited and binds the FFT in a coarse tailings/FFT deposit. Composite Tails are often referred to as "non-segregating" tailings, meaning that the fines do not readily separate from the coarser sand.

Figure 1:
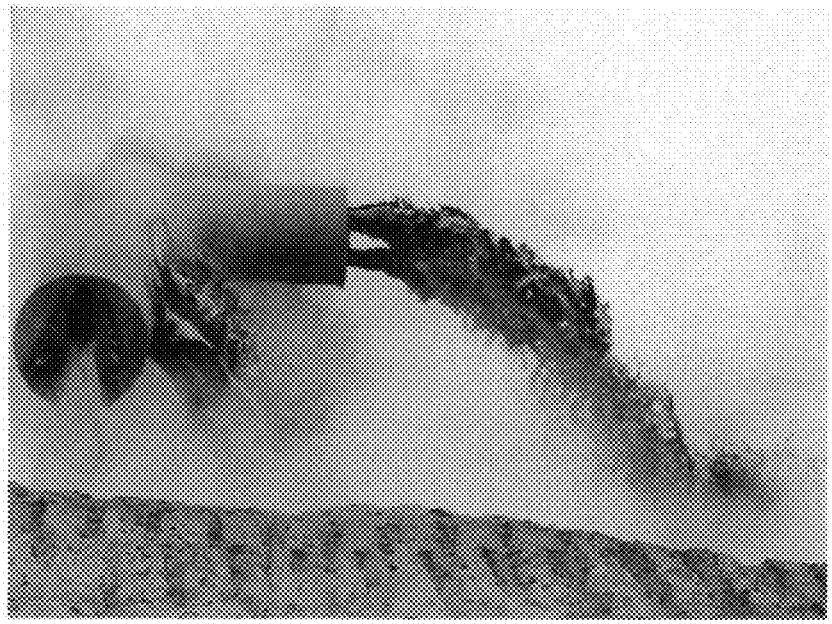
FIG. 1 PRIOR ART
FIG. 1 is a photograph of the prior art device used to dispose oil sands composite tails (CT).
Figure 2:
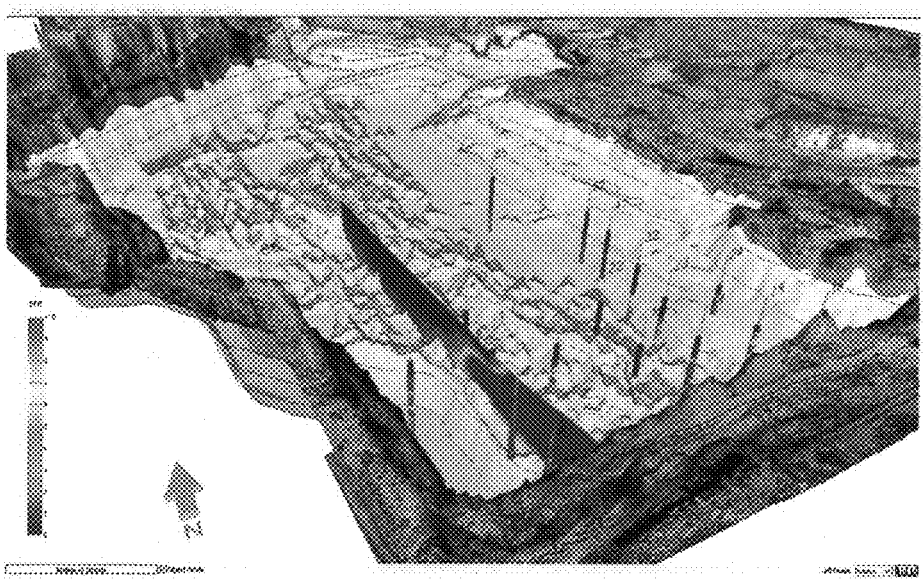
FIG. 2 PRIOR ART
FIG. 2 is a density histogram of an oil sands tailings subaqueous deposition pond where oil sands CT is dispose by the prior art device shown in FIG. 1.

FIG. 1 shows a photograph of a prior art device previously used to dispose oil sands CT. As can be seen from the photograph, use of the prior art discharge device resulted in high energy discharging, resulting in segregation of oil sands CT. Segregation of oil sands CT can be seen in FIG. 2, a density histogram of an oil sands tailings subaqueous disposition pond where oil sands CT is disposed by the prior art device shown in FIG. 1, where the large amount of red (within large circle) represents high sand content and severe segregation in the subaqueous deposit.

Figure 3:
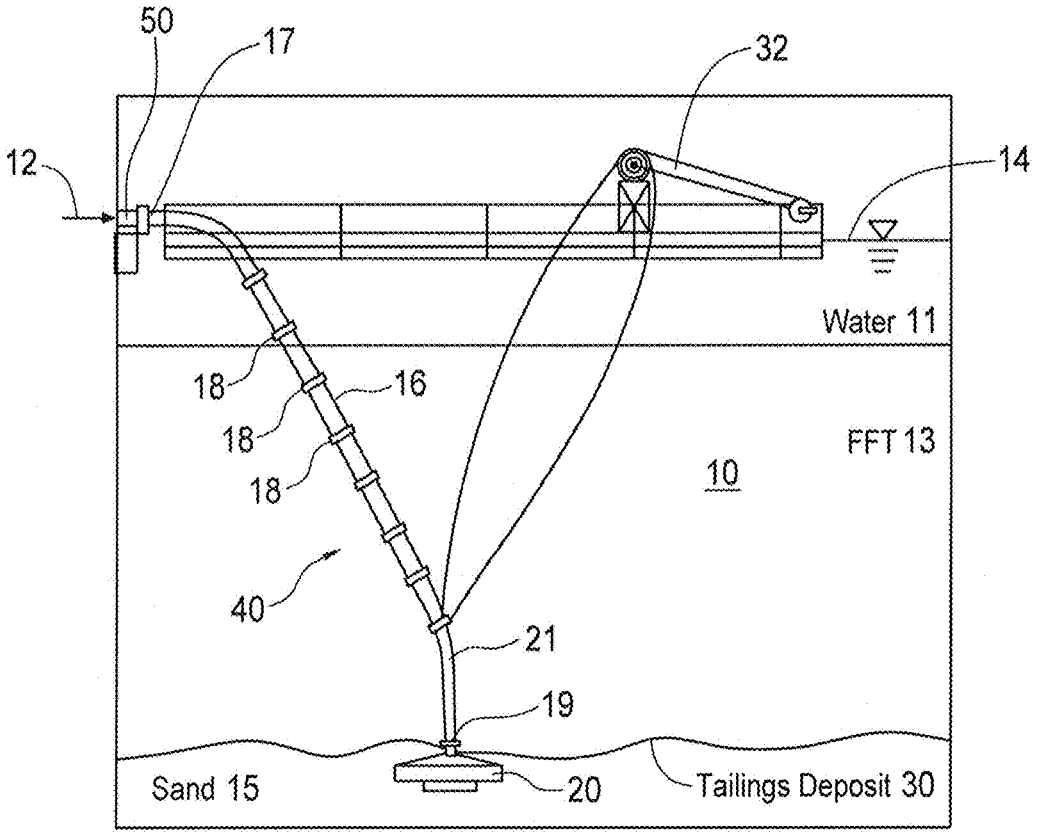
FIG. 3 is a schematic of a mining tailings placement device useful in the present invention.

FIG. 3 shows a mining tailings placement device 40 useful in the present invention which minimizes the energy/velocity of a subaqueous discharge of mining tailings into a column of fluid or body of water 10. In this example, the body of water is an existing oil sands tailings pond comprising a surface water layer 11, a middle layer of fluid finds tailings 13 (also referred to as mature fine tailings) and a sand layer 15 layered over the hard bottom of the column of fluid. At the surface 14 of the body of water 10, oil sands Composite Tails (CT) 20 are introduced into an inclined downpipe 16, which downpipe is often referred to as a tremie. Downpipe 16 comprises an inlet 17, which can be attached to a tailings transport pipe 50, and an outlet 19. Outlet 19 is positioned after a substantially vertical portion 21 of the downpipe 16.

Downpipe 16 further comprises friction elements 18 inside the downpipe which act to minimize the acceleration of the mining tailings, e.g., oil sands CT, as it travels down the downpipe 16. Having the downpipe 16 at an inclined angle also helps reduce acceleration. At the bottom of the downpipe 16, i.e., outlet 19, is a diffuser 20, which is shown in more detail in FIG. 4.

Diffuser 20 comprises an inlet pipe 22 which can attach onto outlet 19 of the downpipe 16. The diffuser 20 can be circular, hexagonal, octagonal, etc. in shape. The important feature, however, is that the diffuser comprises a plurality of plates 24 which essentially divides the internal space of the diffuser 20 into a plurality of compartments 26 and subcompartments (not shown). Thus, the velocity of the oil sands CT exiting the compartments 26 of diffuser 20 will be greatly reduced, as the oil sands CT is being radially diffused thereby reducing segregation of oil sands CT.

Figure 5:
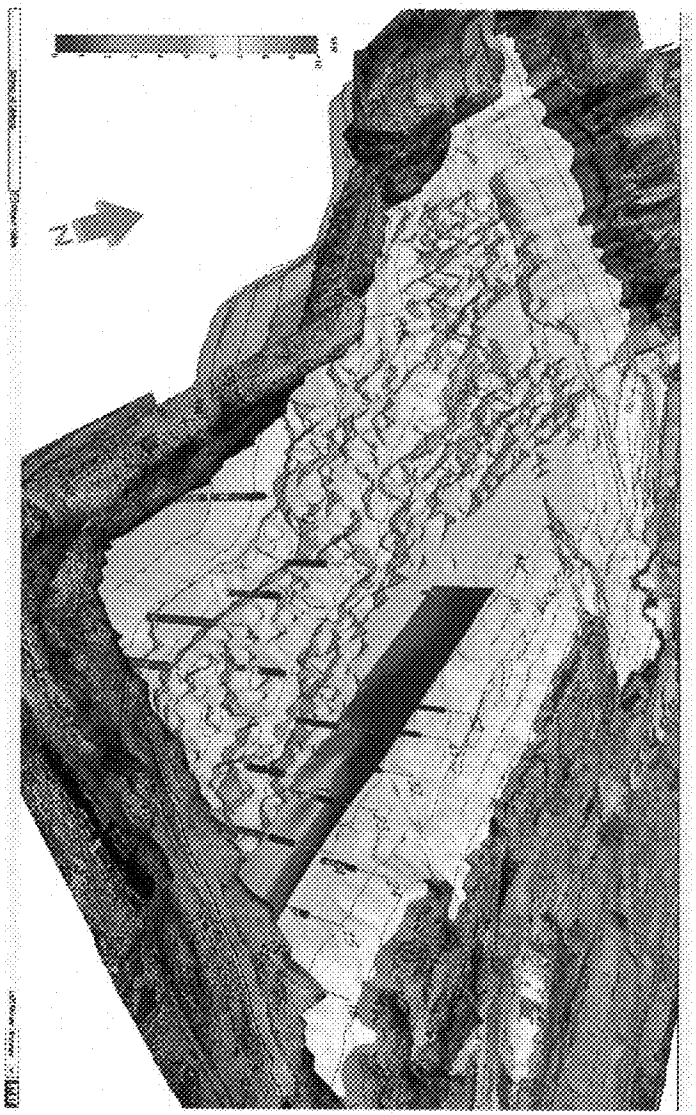
FIG. 5 is a density histogram of an oil sands tailings subaqueous deposition pond where oil sands CT is dispose by the placement device shown in FIG. 3.

Thus, in practice, the present invention manages the discharge velocity of mining tailings through a downpipe and diffuser arrangement. Thus, the tailings deposit 30 will have reduced segregation of the fines from the coarser sand. FIG. 5, a density histogram of an oil sands tailings subaqueous deposition pond where oil sands CT is disposed by the placement device shown in FIG. 3, shows a significant reduction in the segregation of oil sands CT, which is indicated by the substantial reduction in red (small circle) and an increased yellow section, where yellow represents less segregation and higher fines content.

During the subaqueous deposition of mining tailings such as oil sands CT, the deposit growth may be monitored and its characteristics measured in order to determine the deposition pattern. Thus, accordingly, the downpipe 16 and diffuser 20 can be relocated by pulley device 30 to manage deposit surfaces, thereby creating subaqueous deposits with minimal segregation.

Figure 4:
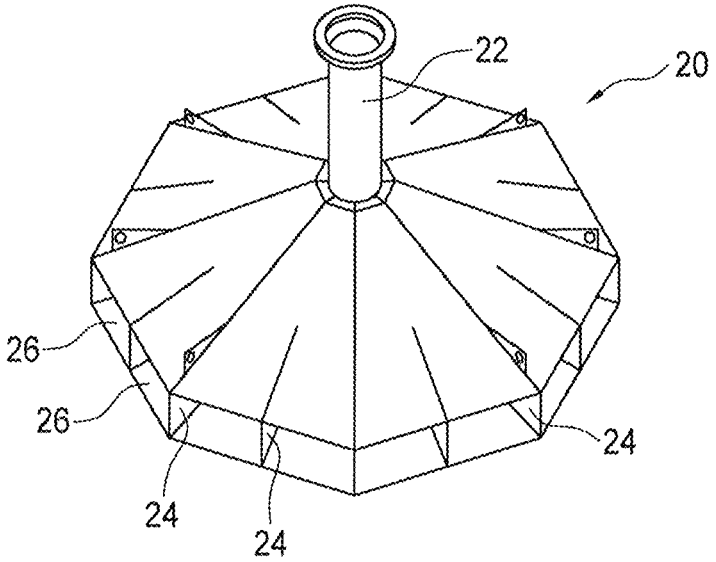
FIG. 4 is a more detailed perspective view of the diffuser of the placement device shown in FIG. 3.
Figure 6:
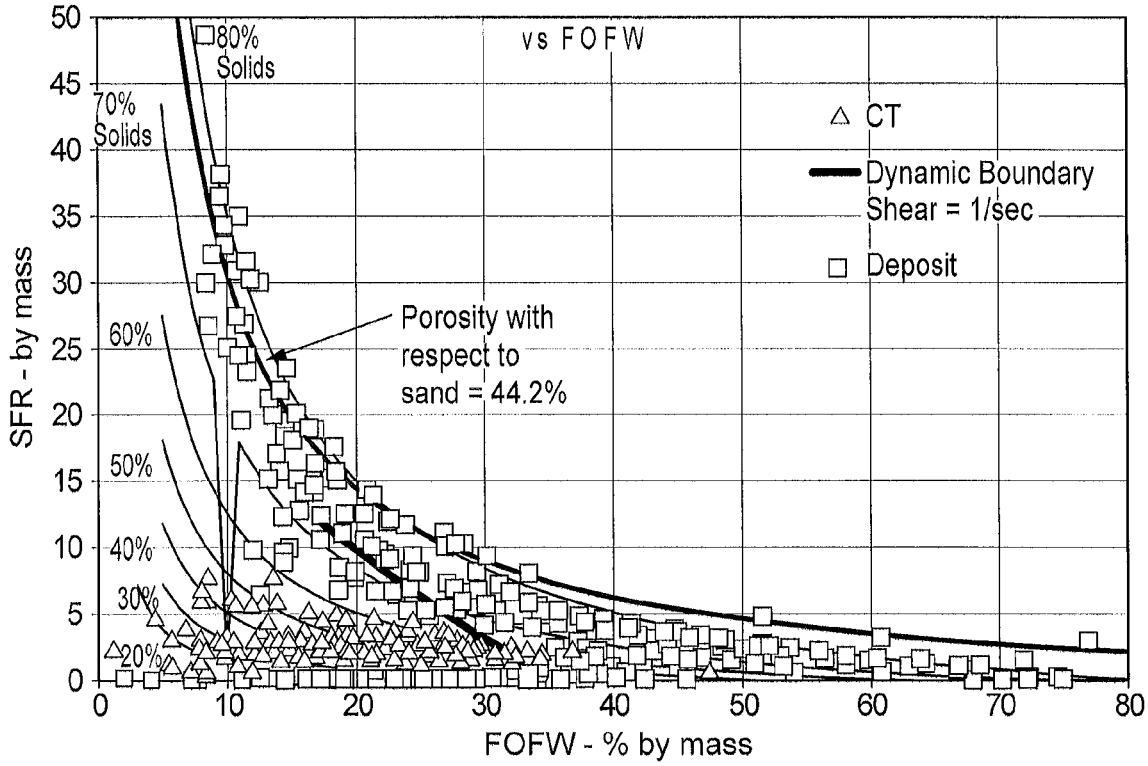
FIG. 6 shows a graph of SFR (by mass) versus FOFW (% by mass) for oil sands composite tails (CT).

FIG. 6 shows a graph of the sand to fines ratio (SFR) (by mass) versus fines over fines plus water (FOFW) (% by mass) for oil sands composite tails (CT) samples, both from the CT Plant, and from the deposit, placed using a tremie downpipe and diffuser as shown in FIG. 3 and FIG. 4. Sand is the mineral fraction having a particle diameter between 44 microns and 2 millimeters, while fines is the mineral fraction having a particle diameter less than 44 microns. The static and dynamic segregation boundaries are also shown, and have been determined as follows:

The static segregation of the oil sands CT is visually inspected by placing a CT sample in a glass cylinder and observing the presence of a light-coloured fines layer atop the dark-coloured CT matrix for Quality Assurance purpose.

The dynamic segregation is determined by observing the segregation of sand grains from the CT matrix inside a concentric cylinder shearing cell. Between the spindle and the wall of the cylinder, the CT samples are sheared at a specific shear rate for a certain period of time to simulate the flow of the CT slurries during deposition on a tailings beach.

The conclusion that can be made from FIG. 6 is that, when oil sands tailings CT is produced at a combined quality of SFR and FOFW, so as to be at above the dynamic segregation boundary, it can be deposited with a tremie and diffuser with minimal segregation. However, when oil sands tailings CT is produced at combined quality of SFR and FOFW below the dynamic segregation boundary, yet even still above the static segregation boundary, segregation is evident in the deposit.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A process for reducing segregation of mining tailings while being deposited below the surface of a column of fluid, comprising:

(a) introducing the mining tailings into a downpipe having an inlet at or near the surface of the column of fluid and an outlet submerged in the column of fluid;

(b) providing at least one pressure drop element in the downpipe to prevent acceleration of the mining tailings and maintain the tailings flow therethrough; and (c) providing a diffusing device at the outlet of the downpipe to reduce the velocity of the mining tailings as the tailings are discharged therefrom.

2. The process as claimed in claim 1, wherein the mining tailings are oil sands tailings.

3. The process as claimed in claim 1, wherein the mining tailings are oil sands composite tails (CT).

4. The process as claimed in claim 1, wherein the column of fluid is an existing mining tailings pond.

5. The process as claimed in claim 2, wherein the oil sands tailings are fluid fine tailings.

6. The process of claim 1, further comprising:

(d) monitoring the mining tailings deposit growth and measuring its characteristics in order to determine deposition pattern.

7. The process as claimed in claim 6, further comprising:

(e) relocating the diffuser to manage deposit surfaces, thereby creating subaqueous deposits with minimal segregation.

8. The process as claimed in claim 1, further comprising:

(d) controlling the velocity of the mining tailings as they are introduced into the downpipe.

9. The process as claimed in claim 1, wherein the downpipe is inclined.

10. The process as claimed in claim 1, wherein the downpipe is substantially vertical.

11. The process as claimed in claim 1, whereby the mining tailings are oil sands CT and the column of fluid is an oil sands tailings pond.

12. The process as claimed in claim 11, whereby the oil sands CT are deposited at or near a sand layer of the oil sands tailings pond.

* * * * *